US006371769B1

(12) United States Patent
Brady

(10) Patent No.: US 6,371,769 B1
(45) Date of Patent: Apr. 16, 2002

(54) MAGNETIC CLAMP ADAPTOR

(75) Inventor: Glenn M. Brady, Cream Ridge, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/838,019

(22) Filed: Apr. 19, 2001

(51) Int. Cl.[7] ..... H01R 11/30; H01R 13/60
(52) U.S. Cl. ..... 439/38; 439/39
(58) Field of Search ..... 439/38, 39, 40, 439/180, 919, 923, 188; 361/144, 214; 324/156, 157

(56) References Cited

U.S. PATENT DOCUMENTS 5,779,487 A * 7/1998 Gatin ..... 439/39
5,829,987 A * 11/1998 Fritsch et al. ..... 439/38
5,931,683 A * 8/1999 Pinel ..... 439/39
6,007,363 A * 12/1999 Renk ..... 439/378
6,030,229 A * 2/2000 Tsutsui ..... 439/39

* cited by examiner

*Primary Examiner*—Brian Sircus
*Assistant Examiner*—Chandrika Prasad
(74) *Attorney, Agent, or Firm*—David L. Davis

(57) ABSTRACT

An adaptor for use with a magnetic clamp device to ground electrical apparatus to a metallic ground plane. The adaptor has a conductive baseplate and at least one clamp member secured to the baseplate for clamping a ground plate flange of the apparatus to the baseplate. The baseplate has a planar region dimensioned to cooperate with the magnetic clamp device so as to be grounded to the ground plane.

4 Claims, 3 Drawing Sheets

MAGNETIC CLAMP ADAPTOR

BACKGROUND OF THE INVENTION

This invention relates to the field of electromagnetic compliance (EMC) testing and, more particularly, to an adaptor for use with a magnetic clamp device for grounding EMC electrical test apparatus in a quick and efficient manner.

Electromagnetic compliance testing is typically done in a specially constructed room having a metal floor which is connected to earth ground. The test apparatus must itself be grounded and for that purpose typically is provided with an outer conductive flange which is placed flat against the metal floor and secured thereto. In the past, such grounding has been accomplished either by using a conductive copper tape or by providing a direct mechanical connection. While effective, these ways of grounding the test apparatus have proven to be time consuming and the use of copper tape has also proven to cause injuries to test personnel. It would therefore be desirable to have a device which can be used to quickly and effectively ground the conductive flange of the test apparatus to the ground plane (i.e., the metal floor).

In U.S. patent application Ser. No. 09/726,182, filed Nov. 29, 2000, (now U.S. Pat. No. 612,831,766) and assigned to the assignee of this invention, there is disclosed a magnetic clamp device which allows the grounding of a conductive flange of test apparatus to a metallic ground plane in a quick and efficient manner. The device includes a top plate and a spring-loaded bar secured to the top plate. The bar is straddled by a pair of magnet assemblies so that when the bar is placed over-the conductive flange of the test apparatus, the magnet assemblies straddle the flange and are magnetically secured to the ground plane, with the spring-loaded bar pressing the flange into conductive engagement with the ground plane. However, some test apparatus is manufactured with flanges which do not extend far enough away from the test apparatus enclosure to be properly grounded by this magnetic clamp device. It would therefore be desirable to have an adaptor which can be used with the magnetic clamp device and which accommodates short flanges.

SUMMARY OF THE INVENTION

According to the present invention, there is provided an adaptor for use with a magnetic clamp device to ground electrical apparatus to a metallic ground plane, wherein the electrical apparatus includes an enclosure and a conductive ground plate extending outwardly from a side of the enclosure so as to form a flange. The adaptor comprises a conductive baseplate and at least one clamp member secured to the baseplate for clamping the flange to the baseplate. The baseplate has a planar region dimensioned to cooperate with the magnetic clamp device so as to be grounded to the ground plane.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 4:
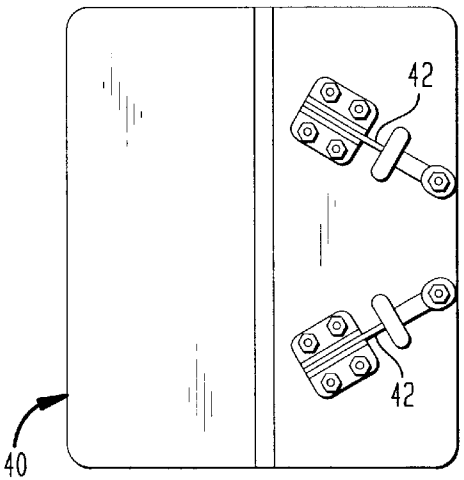
FIG. 4 is a top plan view of another embodiment of an adaptor constructed according to the present invention.
Figure 5:
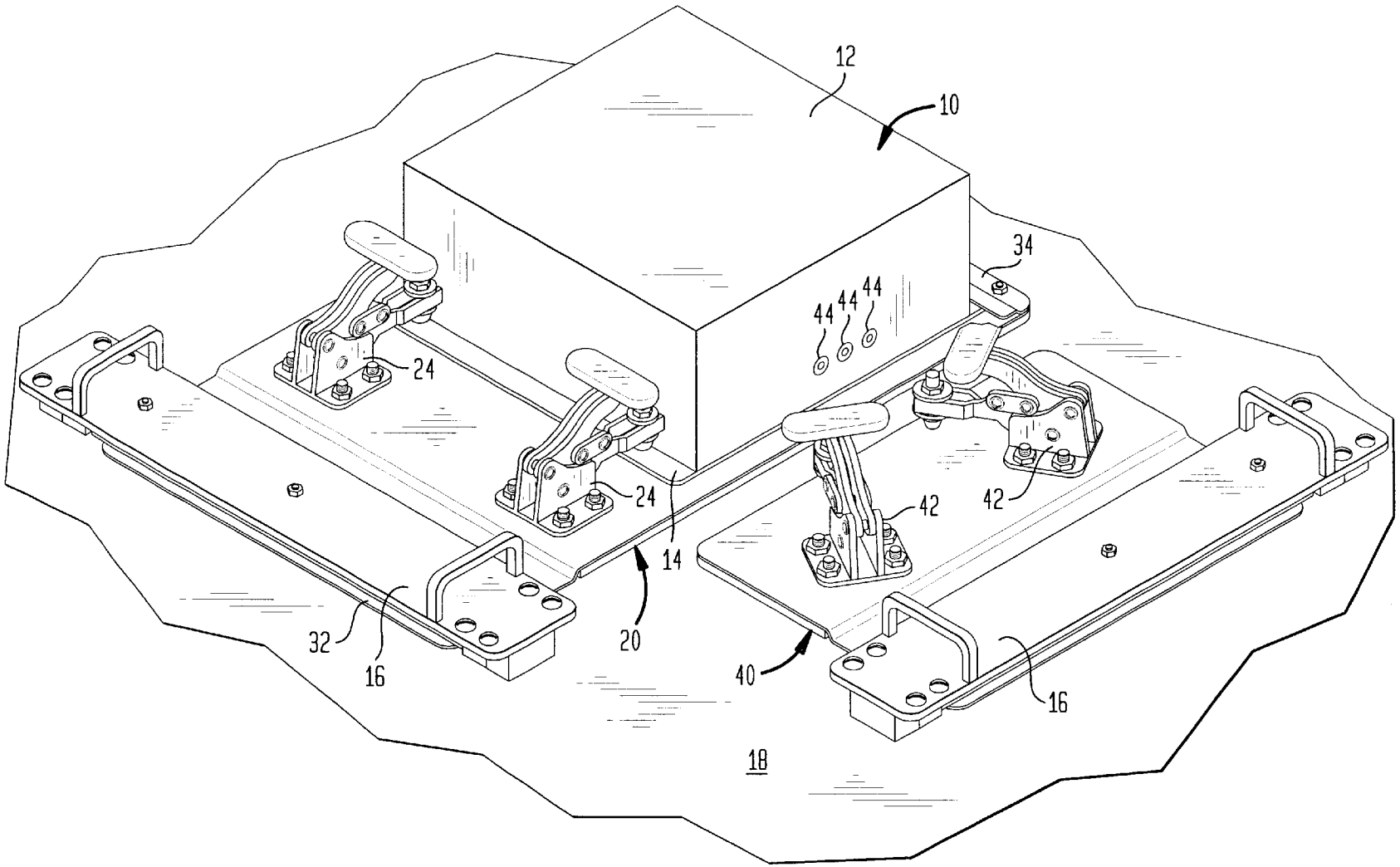
FIG. 5 is a perspective view showing the adaptor embodiments of FIGS. 1–4 in use with a piece of test apparatus.

Referring now to the drawings, FIG. 4 illustrates electrical test apparatus 10 having an outer enclosure 12 and a conductive ground plate 14 which extends outwardly from opposed sides of the enclosure 12 so as to form a pair of opposed flanges. Also shown in FIG. 5 are a pair of magnetic clamp devices 16 of the type disclosed in the aforereferenced patent application. It will be appreciated that for various particular types of electrical test apparatus 10 the flanges formed by the outwardly extending portions of the ground plate 14 are of insufficient size to be secured to the metallic ground plane 18 by a magnetic clamp device 16.

Figure 1:
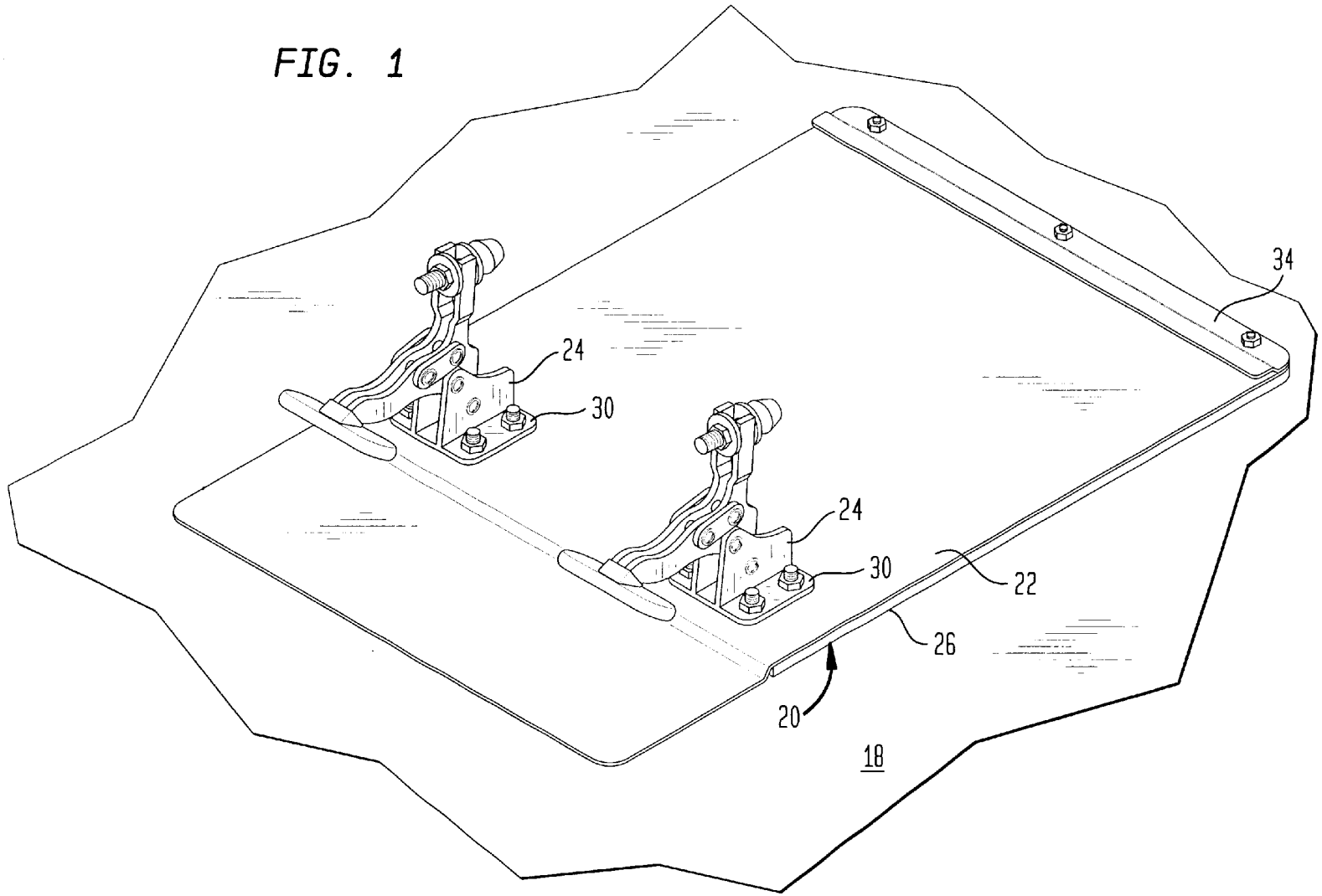
FIG. 1 is a perspective view of an illustrative embodiment of an adaptor constructed in accordance with the present invention.
Figure 2:
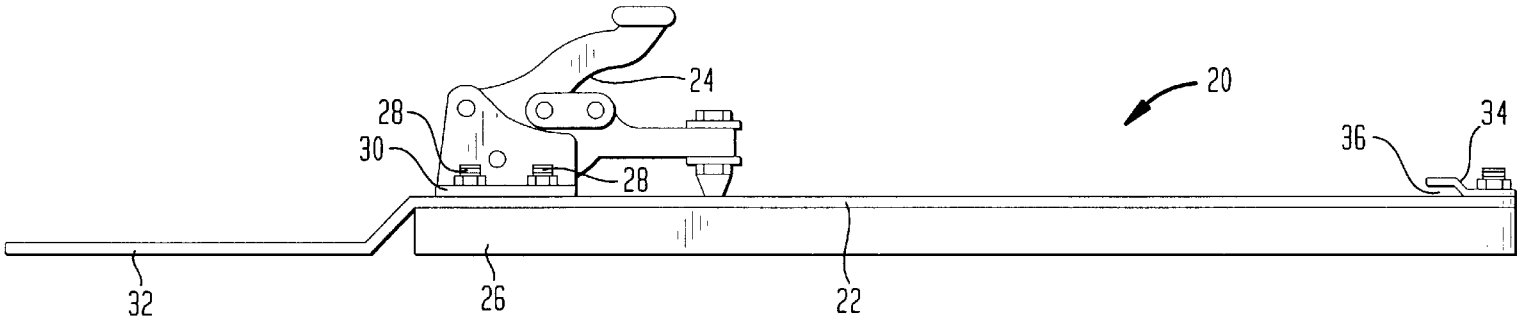
FIG. 2 is a side view of the adaptor shown in FIG. 1.
Figure 3:
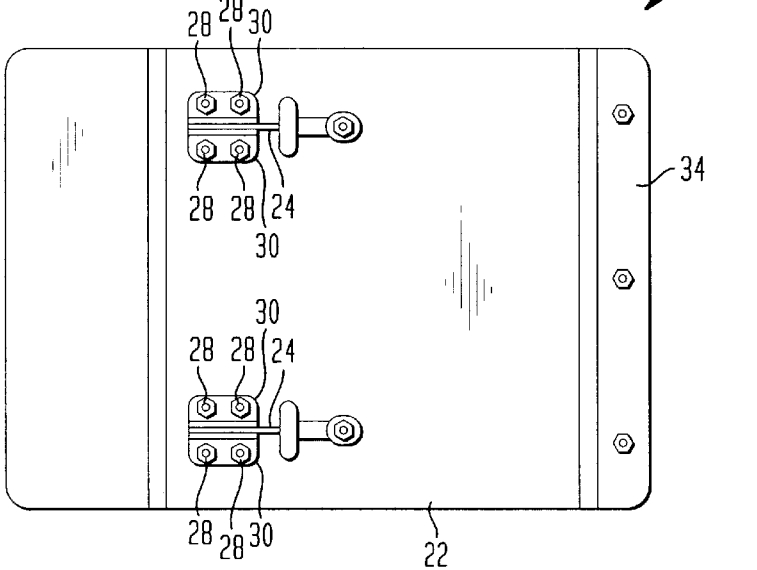
FIG. 3 is a top plan view of the adaptor shown in FIG. 1.

FIGS. 1–3 illustrate an adaptor, designated generally by the reference numeral 20 constructed in accordance with the principles of this invention, to act as an intermediary between the ground plate 14 of the apparatus 10 and the magnetic clamp device 16. As shown, the adaptor 20 includes a conductive baseplate 22. Secured to the baseplate 22 are a pair of toggle clamp members 24. The clamp members 24 are for the purpose of securing the opposed flanges of the electrical apparatus 10 to the conductive baseplate and maintaining good electrical contact therebetween. Accordingly, the clamp members 24 exert a considerable amount of downward force. Therefore, the clamp members 24 must be securely mounted to the baseplate 22. To do this, the baseplate 22 is reinforced by a conductive backing plate 26 and the clamp members 24 are secured to the baseplate 22 and the backing plate 26 by bolts 28 which are countersunk within the backing plate 26 and extend through the backing plate 26, the baseplate 22 and the flanges 30 of the clamp member 24. The reason that a thick baseplate cannot be used is that the magnetic clamp device 16 can only accommodate a limited thickness plate. Accordingly, the backing plate 26 extends under only a portion of the baseplate 22 which will hold the electrical apparatus 10. The baseplate 22 is formed with a pair of bends, as is clearly shown in FIG. 2, to provide a thin planar region 32 which has its lower surface in planar alignment (i.e., is co-planar) with the lower surface of the backing plate 26 so that the adaptor 20 can be placed flush against the ground plane 18. The planar region 32 is dimensioned so that the magnetic clamp device 16 can operatively ground the adaptor 20.

To accommodate electrical apparatus 10 which has a pair of opposed flanges formed from the ground plate 14, the adaptor 20 is formed with a holder member 34 spaced from the clamp members 24. The holder member 34 is an elongated plate secured to the baseplate 22 and having a portion offset from the baseplate 22 so as to form a recess 36 which is sized to receive one of the opposed flanges of the electrical apparatus 10. The spacing between the holder member 34 and the clamp members 24 is such that when one of the flanges is installed within the recess 36, the other flange can be securely clamped to the baseplate 22 by the clamp members 24, as shown in FIG. 5.

Thus, to use the adaptor 20 to ground the electrical apparatus 10, one of the flanges is slid under the holder member 34 within the recess 36. The toggle clamp members 24 are then actuated to clamp the other flange to the baseplate 22. The magnetic clamp device 16 is then used to clamp the thin planar region 32 of the baseplate 22 to the ground plane 18.

The accessory adaptor 40 shown in FIGS. 4 and 5 is similar in construction to the adaptor 20, but is lacking the holder member 34. The accessory adaptor 40 has two toggle clamp members 42 which are used to clamp a ground strap of apparatus used in the calibration of the electrical apparatus 10 and connected thereto through the jacks 44. Like the adaptor 20, the accessory adaptor 40 has a backing plate, and a thin planar region cooperating with the magnetic clamp device 16.

Accordingly, there has been disclosed an adaptor for use with a magnetic clamp device for grounding EMC electrical test apparatus in a quick and efficient manner. While illustrative embodiments of the present invention have been disclosed herein, it will be appreciated by one of skill in the art that various adaptations and modifications to the disclosed embodiments are possible and, accordingly, it is intended that this invention be limited only by the scope of the appended claims.

What is claimed is:

1. An adaptor for use with a magnetic clamp device to ground an electrical apparatus to a metallic ground plane, wherein the electrical apparatus includes an enclosure and a conductive ground plate extending outwardly from a side of the enclosure so as to form a flange, the adaptor comprising:

a conductive baseplate; and at least one clamp member secured to the baseplate for clamping the flange to the baseplate;

wherein the baseplate includes a planar region dimensioned to cooperate with the magnetic clamp device so as to be grounded to the ground plane.

2. The adaptor according to claim 1 wherein the conductive ground plate also extends outwardly from an opposed side of the enclosure so as to form an opposed flange, the adaptor further comprising:

a holder member offset from the baseplate to form a recess of a thickness sized to receive the opposed flange.

3. The adaptor according to claim 2 wherein the spacing between the holder member and the at least one clamp member is such that the at least one clamp member can engage the flange while the opposed flange is received in the recess.

4. The adaptor according to claim 1 further comprising:

a backing plate under a portion of the baseplate to provide support for securing the at least one clamp member to the baseplate;

wherein the planar region extends outwardly of the backing plate and is offset from the portion of the baseplate so that the lower surface of the planar region is in planar alignment with the lower surface of the backing plate.

* * * * *